US009022811B2

(12) United States Patent
Takaki

(10) Patent No.: US 9,022,811 B2
(45) Date of Patent: May 5, 2015

(54) CONNECTOR TERMINAL AND ELECTRIC CONNECTOR

(71) Applicant: Iriso Electronics Co., Ltd., Kanagawa (JP)

(72) Inventor: Masato Takaki, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 14/447,715

(22) Filed: Jul. 31, 2014

(65) Prior Publication Data

US 2015/0044917 A1 Feb. 12, 2015

(30) Foreign Application Priority Data

Aug. 9, 2013 (JP) ..... 2013-167072

(51) Int. Cl.

| | |
|---|---|
| ***H01R 24/00*** | (2011.01) |
| ***H01R 13/6474*** | (2011.01) |
| ***H01R 12/70*** | (2011.01) |
| ***H01R 13/52*** | (2006.01) |
| ***H01R 13/193*** | (2006.01) |

(52) U.S. Cl.

CPC ..... *H01R 13/6474* (2013.01); *H01R 12/70* (2013.01); *H01R 13/52* (2013.01); *H01R 13/193* (2013.01)

(58) Field of Classification Search

USPC ..... 439/330, 325, 637, 60, 682, 692, 331

See application file for complete search history.

(56) References Cited

U.S. PATENT DOCUMENTS 5,496,180 A * 3/1996 Fabian et al. ..... 439/60
5,522,737 A * 6/1996 Brunker et al. ..... 439/637

(Continued)

FOREIGN PATENT DOCUMENTS

EP 1504498 A1 2/2005
JP S52-79564 U 6/1977

(Continued)

OTHER PUBLICATIONS

Notice of Reasons for Rejection from Japanese Patent App. No. 2013-167072 (Sep. 17, 2013) with certified English language translation thereof.

(Continued)

*Primary Examiner* — Alexander Gilman

(74) *Attorney, Agent, or Firm* — Cermak Nakajima & McGowan LLP; Tomoko Nakajima

(57) ABSTRACT

A socket terminal includes front and rear terminals. The front terminal includes a front contact-point portion that wipes off foreign material adhered to a terminal surface of a plug terminal. The rear terminal includes a rear contact-point portion that contacts the terminal surface wiped by the front contact-point portion. The socket terminal also includes a movable portion between a circuit-board connection portion and circuit board. The movable portion cancels a reduction in impedance of at least the front terminal and rear terminal for a transmission signal flowing from the circuit-board connection portion connected to the circuit board. This can provide a socket terminal allowing the rear contact-point portion to contact the terminal surface from which foreign material has been wiped off, and allowing impedance mismatching at a terminal transmission path to be eliminated; and to provide an electric connector including the socket terminal.

9 Claims, 11 Drawing Sheets

(56) References Cited

U.S. PATENT DOCUMENTS

| | | | | | |
|---|---|---|---|---|---|
| 5,848,920 | A | * | 12/1998 | Klein et al. | 439/885 |
| 5,941,715 | A | * | 8/1999 | Huang | 439/60 |
| 6,015,299 | A | * | 1/2000 | Walse et al. | 439/60 |
| 6,099,328 | A | * | 8/2000 | Nelson et al. | 439/101 |
| 6,220,868 | B1 | * | 4/2001 | Pei et al. | 439/60 |
| 6,254,435 | B1 | * | 7/2001 | Cheong et al. | 439/637 |
| RE38,736 | E | * | 5/2005 | Walse et al. | 439/60 |
| 7,150,652 | B1 | * | 12/2006 | Jeon | 439/607.13 |
| 7,351,091 | B1 | * | 4/2008 | Zhang | 439/405 |
| 7,442,089 | B2 | * | 10/2008 | Regnier | 439/637 |
| 7,628,661 | B2 | * | 12/2009 | Liao | 439/862 |
| 7,976,345 | B2 | * | 7/2011 | Szczesny | 439/637 |
| 8,449,335 | B2 | * | 5/2013 | Briant et al. | 439/637 |
| 8,715,009 | B2 | * | 5/2014 | Wu et al. | 439/637 |
| 2012/0142226 | A1 | * | 6/2012 | Funayama et al. | 439/692 |

FOREIGN PATENT DOCUMENTS

| | | | |
|---|---|---|---|
| JP | 2002-175847 | A | 6/2002 |
| JP | 2005-050694 | A | 2/2005 |
| JP | 2006-120448 | A | 5/2006 |
| JP | 2006-216298 | A | 8/2006 |
| JP | 2006-286530 | A | 10/2006 |
| JP | 2008-084756 | A | 4/2008 |
| JP | 2009-199766 | A | 9/2009 |
| JP | 2011-165682 | A | 8/2011 |
| JP | 2012-069243 | A | 4/2012 |
| JP | 2012-129109 | A | 7/2012 |
| WO | WO2010/143520 | A1 | 12/2010 |

OTHER PUBLICATIONS

European Search Report for European Patent App. No. 14179442.0 (Dec. 12, 2014).

* cited by examiner

CONNECTOR TERMINAL AND ELECTRIC CONNECTOR

BACKGROUND OF THE INVENTION

1. Field of the Invention

The present invention relates to a connector terminal and an electric connector that are capable of wiping off foreign material and that are suitable for high-speed transmission.

2. Description of the Related Art

Development in information processing technology and communication technology has dramatically increased the amount of data that is handled by on-vehicle equipment and consumer electric devices. High-speed transmission technology, such as differential transmission (balanced transmission), that can achieve effective transmission of a large amount of data in a short time is used in various electric devices. Therefore, as regards connectors that form part of a transmission path, those that allow impedance matching and that are suitable for high-speed transmission that does not cause distortion in a signal waveform are used.

The basic structure of a connector terminal therefor includes a circuit-board connection portion that is connected to a circuit board and a terminal portion that contacts and is conductively connected with a terminal surface of a mating connector. A "single terminal" that includes only one terminal portion serving as a contact that is connected to the mating connector is generally used.

When foreign material, such as substrate scrap and dust, adhered to connector terminals are interposed between the connector terminals when connecting the connector terminals to each other, poor connection occurs. As means for overcoming this problem, terminal portions of a plurality of terminals including a front terminal and a rear terminal along a fitting direction of a mating connector are known. The front terminal wipes off foreign material adhered to a terminal surface of the mating connector. The rear terminal is fitted to the mating connector following the front terminal and is conductively connected with the terminal surface of the mating connector. Refer to Japanese Unexamined Patent Application Publication No. 2012-69243.

However, the surface area of terminal portions, which become transmission paths, of a plurality of terminals are larger than the surface area of a terminal portion of a single terminal. Therefore, a capacitor component is increased. Consequently, the impedance of the terminal portions is considerably smaller than those of other portions of a connector terminal, as a result of which it becomes difficult to match the impedances. Such a connector terminal is not desirable for, in particular, high-speed transmission of high-frequency signals. For example, it is difficult to meet, for example, high-definition multimedia interface (trade name) standards.

SUMMARY OF THE INVENTION

The present invention is carried out to solve the aforementioned problems. That is, it is an object of the present invention to provide a connector terminal and an electric connector that make it possible to suppress poor connection, caused by foreign material adhered to a terminal surface of a mating connector, by wiping off the foreign material, and that allow impedance matching to be achieved in the connector terminal.

To this end, according to a first aspect of the present invention, there is provided a connector terminal including a circuit-board connection portion that is connected to a circuit board, a terminal portion that contacts a terminal surface of a mating connector, and a base end portion that supports an end of the terminal portion, wherein the terminal portion includes a front terminal and a rear terminal. The front terminal includes a front contact-point portion that wipes off foreign material that is adhered to the terminal surface of the mating connector. The rear terminal includes a rear contact-point portion that contacts the terminal surface of the mating connector that has been wiped by the front contact-point portion. A high-impedance portion is provided between the circuit-board connection portion and the base end portion, the high-impedance portion eliminating impedance mismatching at a terminal transmission path by canceling a reduction in an impedance at least the terminal portion as regards a transmission signal that flows from the circuit-board connection portion at a primary side to the terminal portion at a secondary side.

By providing the connector terminal with a front terminal that wipes off foreign material and a rear terminal that is conductively connected with the terminal surface of the mating connector, it is possible to contact the rear terminal with the terminal surface of the mating connector from which the foreign material has been wiped off and removed by the front terminal. Therefore, it is possible to stably conductively connect the rear terminal and the terminal surface of the mating connector with each other. However, the surface area of the terminal portions of such a plurality of terminals is larger than the surface area of a terminal portion of a single terminal, as a result of which a capacitor component is increased. Consequently, the impedance of the terminal portions is considerably smaller than those of other portions of the connector terminal (see waveform W1 in FIG. 12).

Accordingly, by providing a high-impedance portion between the circuit-board connection portion and the base end portion, a signal that has been transmitted from the circuit-board connection portion, first, passes through the high-impedance portion. Then, the signal passes through the base end portion and is transmitted to a secondary side. Afterwards, the signal passes through the terminal portion and is transmitted to the mating connector. This causes the impedance to increase at the high-impedance portion before the impedance is reduced at the terminal portion. Therefore, it is possible to cancel the reduction in the impedance at the terminal portion by an amount corresponding to an amount indicated by arrow A (see waveform W2 in FIG. 12). In addition, in order to obtain this cancel effect, it is desirable to rapidly reduce the impedance that has started to increase. Consequently, the closer the terminal portion and the high-impedance portion are to each other, the higher the cancel effect. Thus, according to the present invention, a high-impedance portion, which has the following structural features, is provided between the circuit-board connection portion and the base end portion.

Firstly, the high-impedance portion according to the present invention may be formed as a linear terminal section.

By providing a high-impedance portion including a linear portion at the connector terminal, the surface area at this portion becomes small, so that it is possible to increase the impedance.

Secondly, the high-impedance portion may be the linear terminal section provided with a bent portion having a transmission length that cancels the reduction in the impedance at least the terminal portion.

By providing the terminal section with a bent portion, it is possible to adjust the transmission length and match the impedance of the high-impedance portion, which is the primary side of the connector terminal, and the impedance of the terminal portion, which is the secondary side. In addition, by providing the high-impedance portion with a bent portion, it is possible to make compact the connector terminal and the connector and, thus, to save mounting space.

The front terminal and the rear terminal according to the present invention extend along the fitting direction in which the connector is fitted to the mating connector. The terminal section having a bent portion may extend and turn back along the connector fitting direction.

According to this structure, since the terminal section similarly extends parallel to the connector fitting direction similarly to the front terminal and the rear terminal, it is possible for the connector terminal and the entire connector including a bent portion to be compact compared to those in which the terminal section extends in a direction that crosses the connector fitting direction.

Thirdly, the high-impedance portion according to the present invention may be the terminal section that is exposed to outside without being covered by a connector housing.

Among portions of the connector terminal, those that are exposed to air have high impedance. Therefore, by exposing the connector terminal without covering part of the connector terminal by the connector housing, it is possible to increase the impedance without changing the shape of the connector terminal.

Fourthly, the high-impedance portion according to the present invention may be a movable portion that elastically supports the circuit-board connection portion and the base end portion so as to be displaceable relative to each other.

According to this structure, even if the connector terminal is vibrated and the terminal portion is pushed from the terminal surface of the mating connector, it is possible to maintain contact of the terminal portion with the terminal surface of the mating connector by elastically displacing the movable portion serving as the high-impedance portion. Therefore, it is possible to stably connect the connectors and to make the connector terminal and the connector more compact than when the high-impedance portion and the movable portion are separately provided.

The base end portion according to the present invention may have a through hole having a height along the fitting direction in which the connector is fitted to the mating connector, the through hole increasing an impedance at the terminal transmission path beyond the base end portion as a result of a reduction in a surface area of the base end portion.

By providing the base end portion with a through hole that extends therethrough along a plate thickness, the surface area of the base end portion is reduced by an amount corresponding to the size of the through hole. As a result, it is possible to increase the impedance of the transmission path in the terminal beyond the base end portion. In this way, providing the base end portion with a through hole is effective particularly in the following case.

That is, connectors for connecting circuit boards have various heights in accordance with the distances between opposing circuit boards. Therefore, the connectors also need to have various heights in the fitting direction. In one method, the height of a base end portion that supports the terminal portion is varied, to provide a connector that is capable of being used for various distances between the circuit boards.

However, the larger the height of the base end portion, the larger the capacitor component of the high-impedance portion, and the distance from the high-impedance portion to the terminal portion is increased. Therefore, it becomes difficult to provide a cancel effect by the high-impedance portion. Consequently, the base end portion is provided with a through hole to make it possible to increase the impedance of the base end portion that is adjacent to the terminal portion having a low impedance. This makes it possible to increase the effect of cancelling the reduction in the impedance of the terminal portion.

The base end portion according to the present invention may have a side edge along the connector fitting direction in which the connector is fitted to the mating connector, and at least one of the front terminal and the rear terminal may project sideways from the side edge of the base end portion and, then, bend and extend in the fitting direction in which the connector is fitted to the mating connector.

By providing an upper edge at the upper side of the base end portion (the side of the mating connector in the mating connector fitting direction), the terminal portion can extend upward from the upper edge.

Alternatively, for example, at least one of the front terminal and the rear terminal may extend upward from a side edge instead of from the upper edge at the upper side of the base end portion. This makes it possible to reduce the height of the connector terminal while maintaining the length of the terminal portion. Thus, it is possible for the connector terminal to be settable even in a narrow space between circuit boards.

According to a second aspect of the present invention, there is provided an electric connector including any one of the connector terminals according to the invention; and a housing that accommodates the any one of the connector terminals.

The electric connector can be used for high-speed transmission, provides high connection reliability due to its foreign material removal function, and provides the operation/advantages of any one of the above-described connector terminals according to the present invention.

The housing according to the present invention may include a stationary housing to which the circuit-board connection portion is secured and a movable housing to which the base end portion is secured, and the high-impedance portion may elastically support the stationary housing and the movable housing so that the movable housing is displaceable relative to the stationary housing.

According to the above-described structure, there is provided a floating connector in which the high-impedance portion that is secured to a circuit board and that serves as a movable portion floatingly supports the stationary housing and the movable housing so as to be displaceable relative to each other.

The housing according to the present invention may include a space portion that exposes the high-impedance portion to air without contacting the high-impedance portion.

By exposing the high-impedance portion to air through the space portion, it is possible to increase the impedance.

According to the present invention, it is possible to provide a connector terminal and an electric connector, which are capable of facilitating impedance matching and preventing poor connection caused by foreign material adhered to a terminal surface of a mating connector. Therefore, it is possible to provide a connector terminal and an electric connector in which poor connection, caused by foreign material, is less likely to occur and which provide good, highly reliable high-speed transmission characteristics.

DESCRIPTION OF THE PREFERRED EMBODIMENTS

Figure 1:
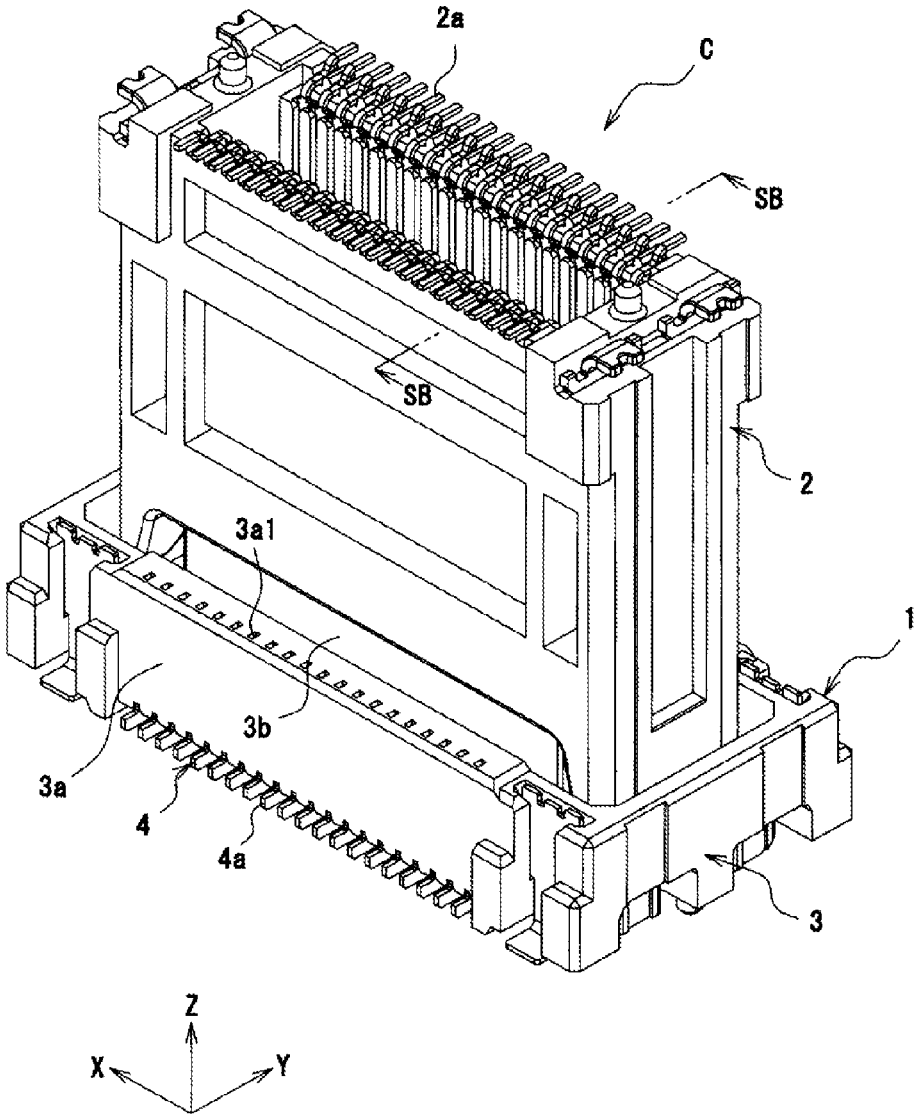
FIG. 1 is a perspective view of a state in which a socket and a plug according to a first embodiment are fitted to each other.

Embodiments of the present invention are hereunder described with reference to the drawings. Structural portions that are common in the embodiments below are given the same reference numerals and the same descriptions thereof are not repeated.

First Embodiment (FIGS. 1 to 7)

Figure 2:
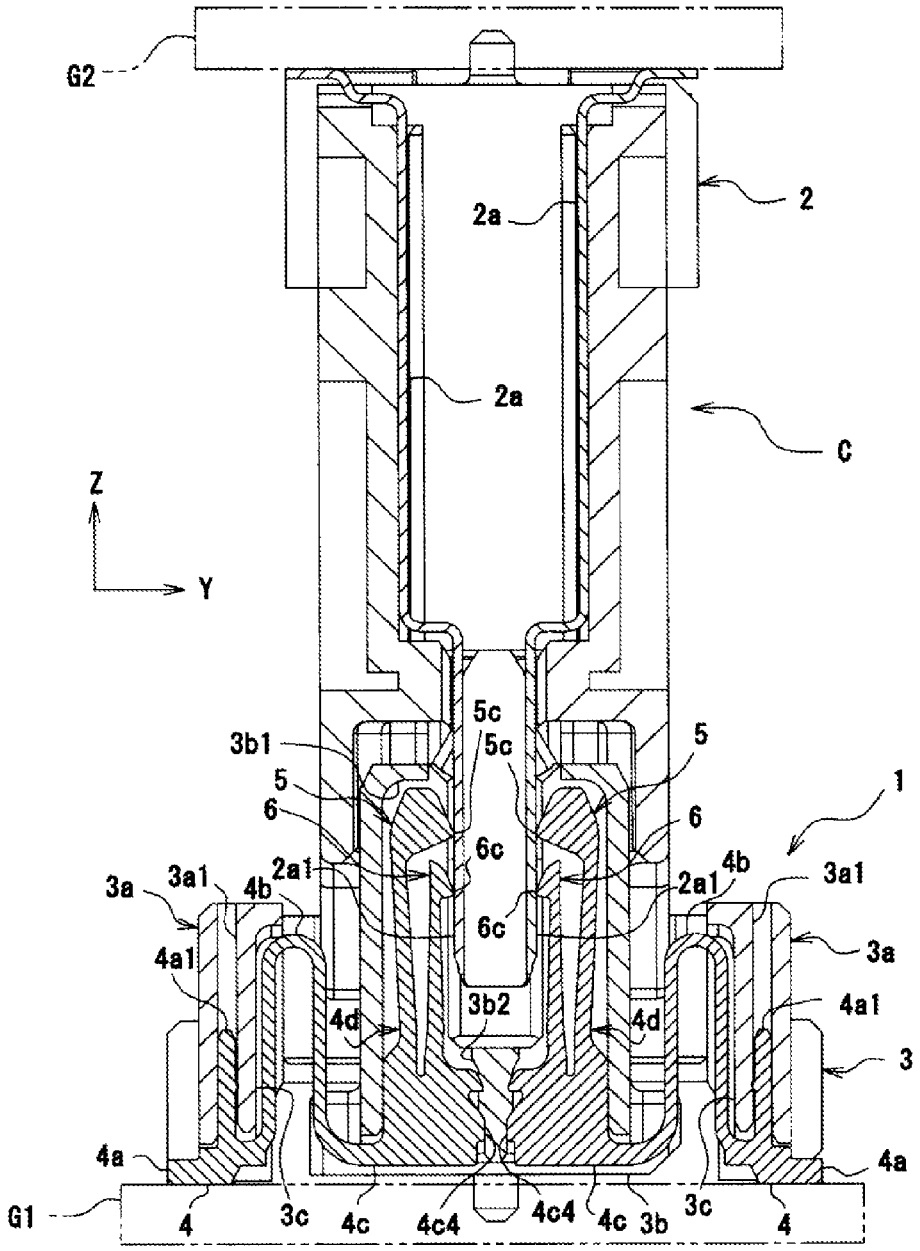
FIG. 2 is a sectional view taken along line II-II in FIG. 1.

An electric connector C of the first embodiment according to the present invention includes a socket 1 and a plug 2. As shown in FIG. 2, the socket 1 is secured to a circuit board G1. As shown in FIG. 1, by fitting the socket 1 to the plug 2 (serving as a "mating connector"), the circuit board G1 and a circuit board G2 to which the plug 2 is secured are conductively connected with each other.

As shown in FIGS. 1 and 2, the socket 1 includes a substantially rectangular parallelepiped socket housing 3 and socket terminals 4 that are conductively connected with plug terminals 2*a*.

Socket Housing

The socket housing 3 is formed of insulating resin. As shown in FIGS. 1 and 2, the socket housing 3 includes a stationary housing 3*a* and a movable housing 3*b* that is displaceable relative to the stationary housing 3*a* by the socket terminals 4. The stationary housing 3*a* is provided with stationary holes 3*a*1 to which the socket terminals 4 are secured. The movable housing 3*b* is provided with accommodation portions 3*b*1 that accommodate terminal portions 4*d* and base end portions 4*c* of the socket terminals 4. Partition walls 3*b*2 are provided at a substantially lower center position of the movable housing 3*b*. Each partition wall 3*b*2 divides its corresponding accommodation portion 3*b*1 in two at substantially the center of the socket 1 in a short-side direction Y of the socket 1, and is used for securing the socket terminals 4. The socket terminals 4 are secured to the socket housing 3 and are disposed at equal intervals along a longitudinal direction X of the socket housing 3.

Socket Terminals

Figure 3:
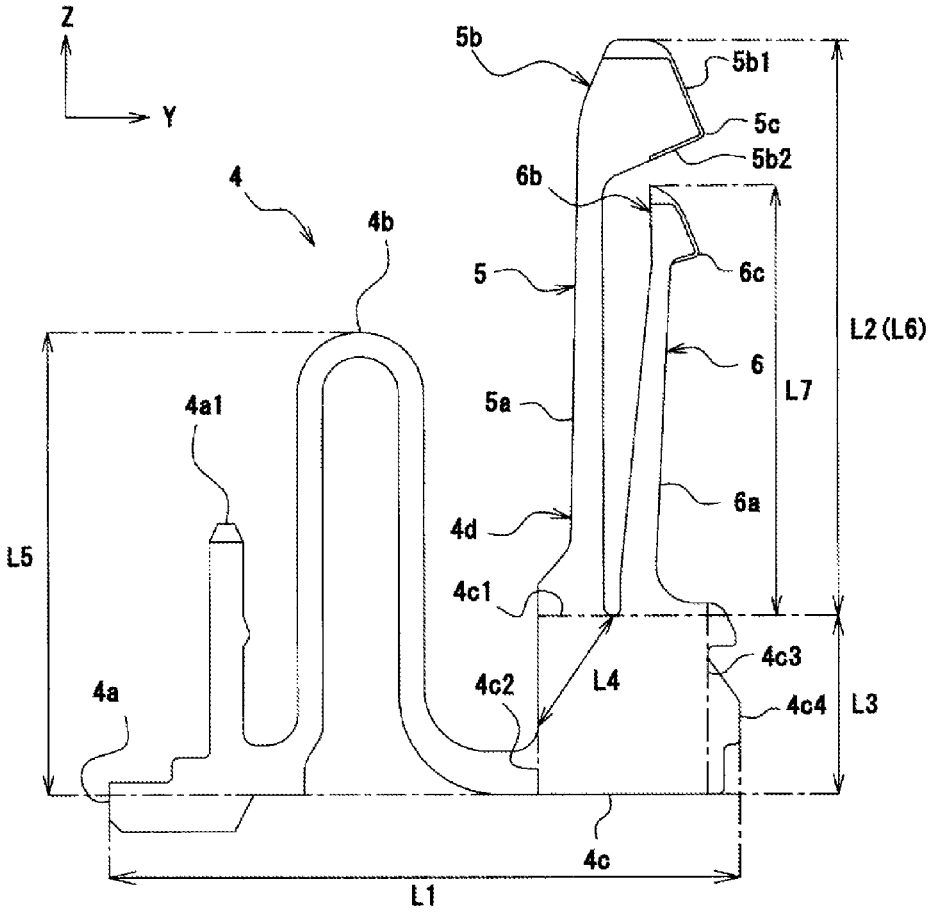
FIG. 3 is a side view of a socket terminal shown in FIG. 2.

The socket terminals 4 according to the embodiment are extraction terminals formed by punching a conductive metallic plate by a pressing operation. As shown in FIGS. 2 and 3, each socket terminal 4 includes a circuit-board connection portion 4*a* that is connected to the circuit board G1, a substantially inverted U-shaped movable portion 4*b*, a base end portion 4*c* that is provided adjacent to the movable portion 4*b*, and a terminal portion 4*d* that extends from the base end portion 4*c*. Each terminal portion 4*d* includes a front terminal 5 and a rear terminal 6. Each rear terminal 6 is adjacent to its corresponding front terminal 5 and extends from its corresponding base end portion 4*c*, and is disposed below its corresponding front terminal 5 (that is, at the side of the socket 1 in a fitting direction Z of the plug 2).

A securing portion 4*a*1 extends upward (that is, towards the side of the plug 2 in the fitting direction Z of the plug 2) from the circuit-board connection portion 4*a* of its corresponding socket terminal 4. Each securing portion 4*a*1 is secured to the socket housing 3. Each socket terminal 4 is mounted so that its plate surface is parallel to the short-side direction Y of the socket housing 3. The socket terminals 4 are mounted in pairs so as to oppose each other in the accommodation holes 3*b*1 of the socket housing 3 with the corresponding partition walls 3*b*2 being disposed therebetween.

Movable Portions

As shown in FIGS. 2 and 3, each movable portion 4*b* has a substantially inverted U shape, and has a linear form that is thinner than other portions. Therefore, each movable portion 4*b* can undergo spring-like elastic deformation when, for example, each movable portion 4*b* is pushed from the corresponding plug terminal 2*a* or the socket 1 is vibrated.

While each socket terminal 4 is secured to the socket housing 3, the corresponding movable portion 4*b* is disposed in a space portion 3*c* that is formed between the movable housing 3*b* and the stationary housing 3*a*, and is exposed to air. The movable portions 4*b* that are accommodated in the space portions 3*c* allow the movable housing 3*b* to be displaced relative to the stationary housing 3*a*.

Base End Portions

As shown in FIGS. 2 and 3, the base end portion 4*c* of each socket terminal 4 is provided adjacent to its corresponding movable portion 4*b*, with its plate surface being flat and having a substantially square shape. The front terminal 5 and the rear terminal 6 project upward from their corresponding upper edge 4*c*1 in a cantilever manner. Each side edge 4*c*3 disposed opposite to its corresponding side edge 4*c*2 connected to the movable portion 4*b* is provided with an uneven holding portion 4*c*4 used for securing the socket terminal 4 by causing each socket terminal 4 to mesh with the partition wall 3*b*2 of its corresponding movable housing 3*b*.

Front Terminals

As shown in FIGS. 2 and 3, each front terminal 5 includes an elastic portion 5*a* that extends from the base end portion 4*b* and a contact portion 5*b* that is provided at an end of the elastic portion 5*a*. Each contact portion 5*b* is formed in a chevron form in which a front edge 5*b*1, a front contact-point portion 5*c*, and a rear edge 5*b*2 protrude in a direction of contact with a terminal surface 2*a*1 of the plug terminal 2*a*. Each front edge 5*b*1 removes foreign material that adheres to the terminal surface 2*a*1 of the corresponding plug terminal 2*a*. Each front contact-point portion 5*c* contacts the terminal surface 2*a*1 of the corresponding plug terminal 2*a*. An inside angle between each front edge 5*b*1 and its corresponding rear edge 5*b*2 is 91 degrees, so that foreign material scraped off by each front edge 5*b*1 is caught by and adheres to a wide plate surface and is less likely to drop from its corresponding socket terminal 4.

Rear Terminals

As shown in FIGS. 2 and 3, each rear terminal 6 includes an elastic portion 6*a* that is connected to the base end portion 4*c* and a contact portion 6*b* that is provided at an end of the elastic portion 6*a*. Each contact portion 6*b* is provided with a rear contact-point portion 6*c* that protrudes in a chevron form in the direction in which the contact portion 6*b* contacts the corresponding plug terminal 2*a*. Each rear terminal 6 is provided adjacent to its corresponding front terminal 5. Each rear contact-point portion 6*c* is provided below its corresponding front contact-point portion 5*c* in a direction in which each front contact-point portion 5*c* and the plug 2 are fitted to each other. A contact pressure at each rear terminal 6 is higher than a contact pressure at each front terminal 5, so that the rear terminals 6 can firmly conductively contact the plug terminals 2*a*.

The socket terminals 4 are secured to the socket housing 3 by press-fitting the securing portions 4*a*1 to the stationary holes 3*a*1 of the stationary housing 3*a*, and, at the same time, accommodating the terminal portions 4*d* and the base end portions 4*c* in the accommodation portions 3*b*1 of the movable housing 3*b*, press-fitting the holding portions 4*c*4 to the partition walls 3*b*2 of the movable housing 3*b*, and causing the holding portions 4*c*4 to mesh with the partition walls 3*b*2.

Explanation of Foreign Material Removal Function

The plug terminals 2*a* and the socket terminals 4 are brought into contact and conductive connection with each other by fitting the plug 2 to the socket 1. However, foreign material, such as substrate scrap and dust, is sometimes adhered to the terminal surface 2*a*1 of each plug terminal 2*a*. When, in this state, the rear contact-point portions 6*c* contact the terminal surfaces 2*a*1 of the plug terminals 2*a*, such foreign material enters a location between the rear contact-point portions 6*c* and the terminal surfaces 2*a*1 of the plug terminals 2*a*. This may cause unstable conductive connection between the rear contact-point portions 6*c* and the plug terminals 2*a*.

However, as shown in FIGS. 2 and 3, when each front contact-point portion 5*c* is provided above its corresponding rear contact-point portion 6*c*, and each front contact-point portion 5*c* and each rear contact-point portion 6*c* are successively brought into sliding contact with the terminal surface 2*a*1 of the corresponding plug terminal 2*a* when the plug 2 has been inserted into the socket 1, it is possible to wipe off such foreign material adhered to the terminal surface 2*a*1 of the corresponding plug terminal 2*a* by each front contact-point portion 5*c* and its corresponding front edge 5*b*1. Then, when each rear contact-point portion 6*c* is brought into contact with a portion of the terminal surface 2*a*1 of its corresponding plug terminal 2*a* where such foreign material has been wiped off, it is possible to achieve stable conductive connection between each rear contact-point portion 6*c* and its corresponding plug terminal 2*a* without such foreign material existing therebetween.

Explanation of Floating Function

The socket 1 includes the stationary housing 3*a* and the movable housing 3*b* that is displaceable relative to the stationary housing 3*a*. Each movable portion 4*b* elastically supports the movable housing 3*b* so as to be displaceable relative to the stationary housing 3*a*. When the socket 1 has such a floating structure, even if the socket 1 is vibrated or, for example, the plug terminals 2*a* push the socket terminals 4, the displacement of the socket terminals 4 can be absorbed by a spring-like elastic deformation of the movable portions 4*b*. Therefore, it is possible to maintain a state in which the front terminals 5 and the rear terminals 6 are in contact with the terminal surfaces 2*a*1 of the plug terminals 2*a*.

Explanation of Impedance Matching

Here, impedance matching of the socket terminals 4 according to the embodiment is described.

In order for the socket 1 to be a connector terminal that can be used for high-speed transmission that meets, for example, HDMI standards, impedance matching is indispensable. However, it is difficult to achieve impedance matching in existing connector terminals with wiping functions. More specifically, since a plurality of terminals including a front terminal 5 and a rear terminal 6 are provided for providing wiping functions, the surface areas of the terminal portions 4*d* are larger than the surface area of a terminal portion of a single terminal. Therefore, a capacitor component of the terminal portions 4*d* is increased. Consequently, the impedances of the terminal portions 4*d* may be considerably smaller than those of other portions of the socket terminals 4. This state is not desirable for high-speed transmission of high-frequency signals. As a result, it is difficult to meet, for example, HDMI standards.

Accordingly, in each socket terminal 4 according to the embodiment, a high-impedance portion is provided between each base end portion 4*c* and its corresponding circuit-board connection portion 4*a*. In the embodiment, as high-impedance portions, the substantially inverted U-shaped movable portions 4*b* having linear terminal widths are provided. Since the movable portions 4*b* have linear terminal widths and have small surface areas, the impedance is increased. In addition, while the socket terminals 4 are mounted on the socket housing 3, each movable portion 4*b* is disposed in the space portion 3*c* that is formed between the movable housing 3*b* and the stationary housing 3*a*, and is exposed to air. Therefore, the impedance of the movable portions 4*b* is further increased.

A signal that is transmitted to each circuit-board connection portion 4*a* from the circuit board G1 is, in the interior of its corresponding socket terminal 4, transmitted through the circuit-board connection portion 4*a*, the movable portion 4*b*, the base end portion 4*c*, and the terminal portion 4*d* (serving as a transmission path in the terminal). Then, the signal is transmitted to the terminal surface 2*a*1 of each plug terminal 2*a* from the corresponding terminal portion 4*d*. In order to achieve impedance matching of each socket terminal 4, since, in the embodiment, the impedance of a secondary-side transmission path, formed by one base end portion 4*c* and two terminal portions 4*d*, is relatively low, the impedance of a primary-side transmission path, formed by the circuit-board connection portion 4*a* and the movable portion 4*b*, is set relatively high by the movable portion 4*b* (serving as the aforementioned high-impedance portion). In this state, impedance matching is performed. By providing each movable portion 4*b* close to its corresponding terminal portion 4*d*, it is possible to cancel a reduction in the impedance at each terminal portion 4*d* by increasing the impedance at each movable portion 4*b* before the impedance is reduced at each terminal portion 4*d*.

Figure 4:
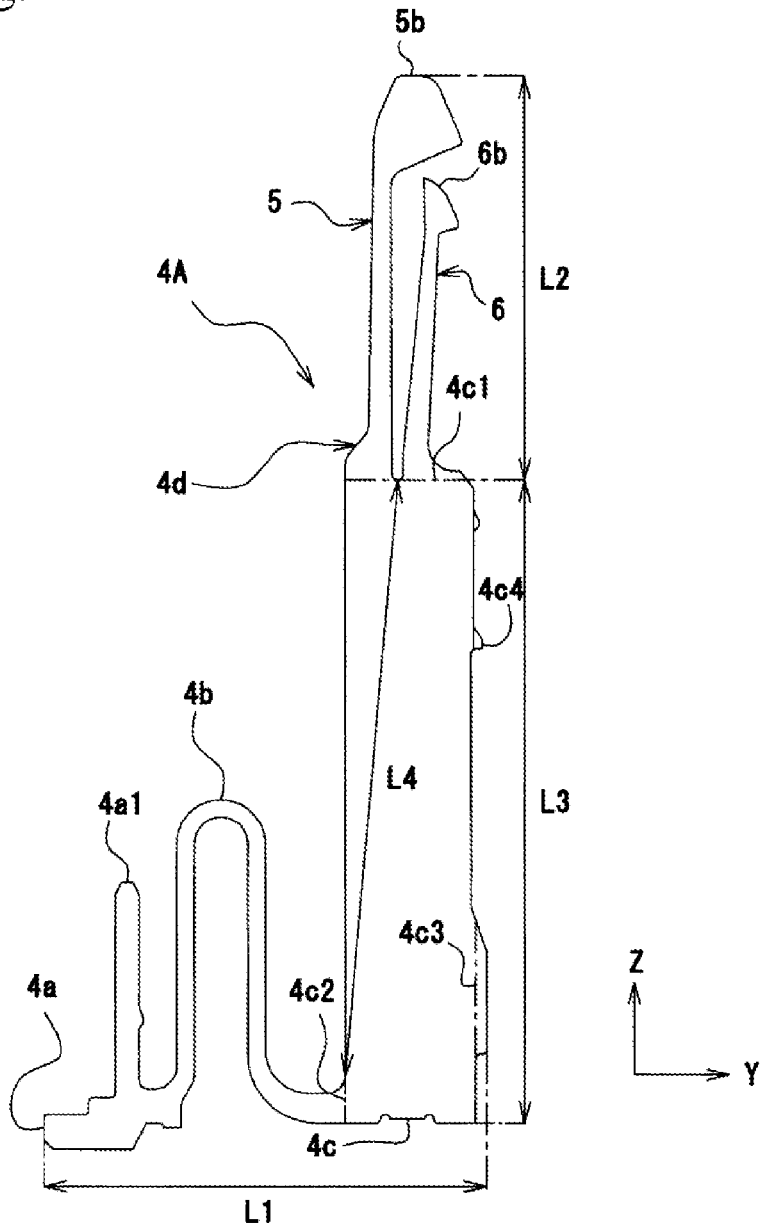
FIG. 4 is a side view of a tall socket terminal used in measuring impedance.
Figure 5:
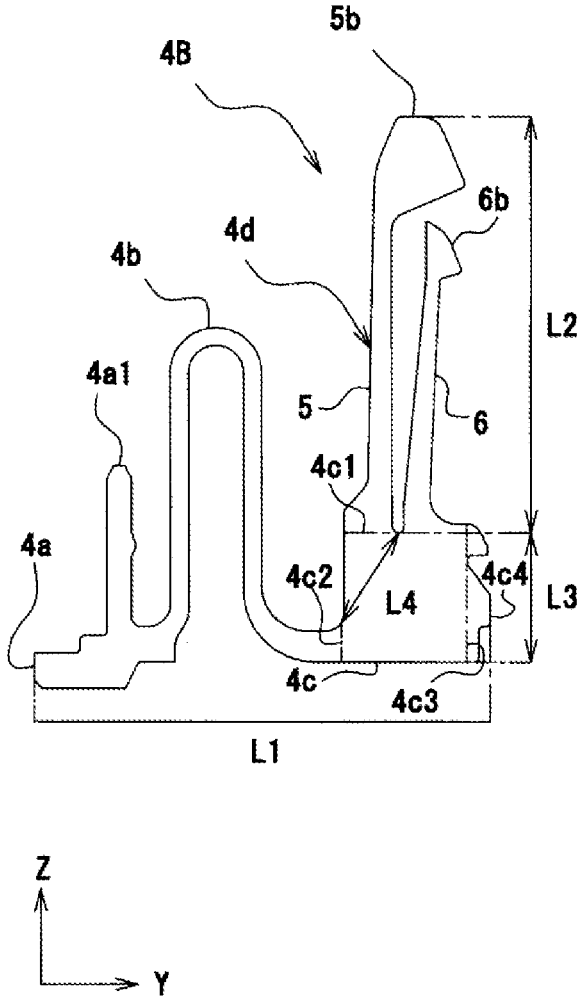
FIG. 5 is a side view of a short socket terminal used in measuring impedance.

Each movable portion 4*b* has a length at which the impedance becomes a value that is capable of cancelling a reduction in the impedance at each terminal portion 4*d*. FIGS. 4 and 5 show a socket terminal 4A having a particular shape and a socket terminal 4B having a particular type, respectively. In each of the socket terminals 4A and 4B, a length L1 in a width direction is on the order of 5 mm and a height L2 of a terminal portion 4*d* is on the order of 5 mm. However, in the socket terminals 4A and 4B, heights L3 of base end portions 4*c* and distances L4 between the base end portions 4*c* and terminal portions 4*d* differ. In the socket terminal 4A shown in FIG. 4, the height L3 of the base end portion 4*c* is approximately 5.3 mm, and the distance L4 between the base end portion 4*c* and the terminal portion 4*d* is approximately 7.27 mm. In the socket terminal 4B shown in FIG. 5, the height L3 of the base end portion 4*c* is approximately 1.5 mm, and the distance L4 between the base end portion 4*c* and the terminal portion 4*d* is approximately 1.2 mm.

Figure 6:
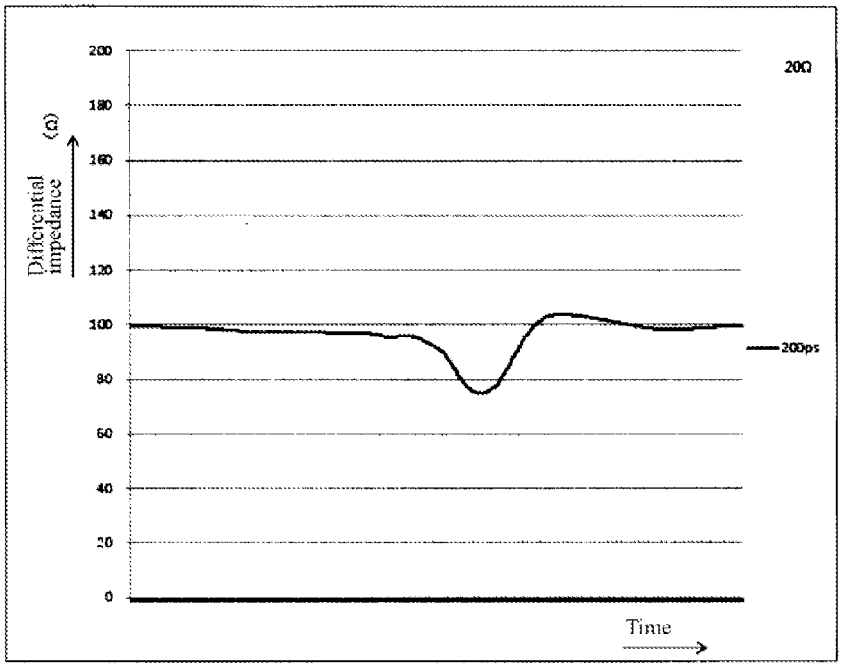
FIG. 6 is a graph of a waveform of impedance in the socket terminal shown in FIG. 4.
Figure 7:
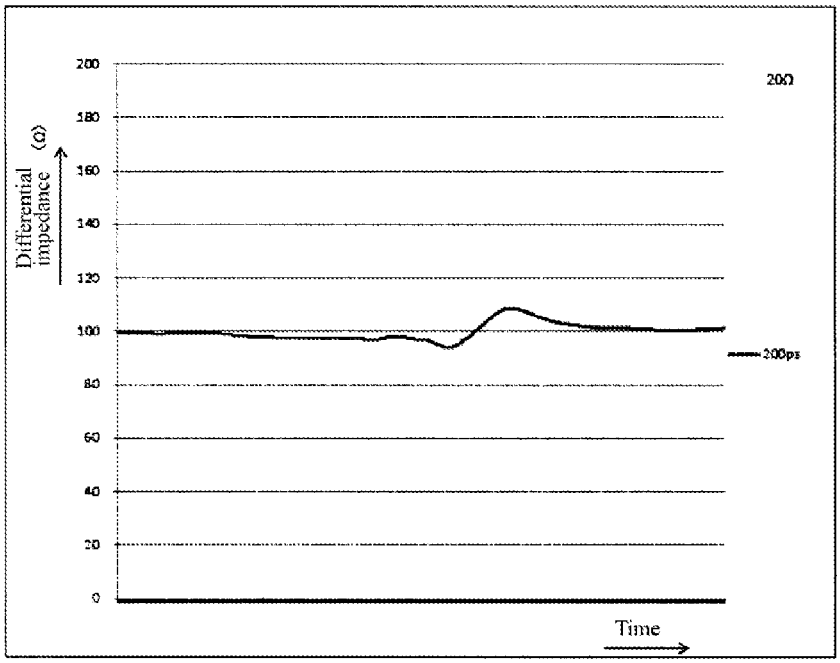
FIG. 7 is a graph of a waveform of impedance in the socket terminal shown in FIG. 5.

Waveforms of measured impedances of the socket terminals 4A and 4B are shown in FIGS. 6 and 7. According to each waveform, the smaller the height L3 of the base end portion 4*c*, the smaller the difference between the impedances. This is because, as the height of the base end portion 4*c* is reduced and the distance L4 between the movable portion 4*b* and the terminal portion 4*d* is reduced, it is possible to cancel a reduction in the impedance at the terminal portion 4*d* by causing the impedance at the terminal portion 4*d* to be reduced when the impedance at the movable portion 4*b* starts to increase. For example, in HDMI standards, it is necessary for the differential impedance to be within a value on the order of 100Ω±15%. According to the embodiment, it is possible to meet this standard requirement.

The closer the movable portion 4*b* and its corresponding terminal portion 4*d* are to each other, the higher the cancel effect. For example, in the structure of the socket terminal 4A in which the height of the base end portion 4*c* is large, it is desirable that the distance L4 between the movable portion 4*b* and the terminal portion 4*d* be less than or equal to 7 mm. This makes it possible to meet HDMI standards. The height of the base end portion 4*c* may be changed in accordance with the interval between the circuit board G1 and the circuit board G2.

For example, the shape of the socket terminal 4, the total surface area at a plate surface side, the entire length of the terminal portion 4*d* (that is, the total of the height L6 of the front terminal 5 and the height L7 of the rear terminal 6), and the length of the movable portion 4*b* also influence the impedance of its corresponding socket terminal 4. Therefore, by adjusting these, a reduction in the impedance at each terminal portion 4*d* can be efficiently canceled. The entire length of each movable portion 4*b* in the embodiment is substantially equal to the total of the length of the front terminal 5 and the length of the rear terminal 6. In addition, the width of each linear movable portion 4*b* in the direction Y is substantially equal to the terminal width of at least one of the front terminal 5 and the rear terminal 6. Further, the surface area at the plate surface side of each movable portion 4*b* and the total surface area at the plate surface side of each terminal portion 4*d* are substantially equal. Therefore, these are also factors that increase the effect of cancelling a reduction in the impedance at each terminal portion 4*d*.

According to the embodiment, it is possible to provide a socket terminal 4 in which foreign material adhered to the terminal surface 2*a*1 of each plug terminal 2*a* is wiped off by the corresponding front contact-point portion 5, so that stable conductive connection of each rear contact-point portion 6*c* with the terminal surface 2*a*1 of its corresponding plug terminal 2*a* from which such foreign material has been wiped off can be achieved; and in which high-speed transmission is possible.

If the socket terminal 4 is used, it is possible to achieve high-speed transmission that meets, for example, HDMI standards. Therefore, it is possible to achieve stable communication of a large amount of data in a short time while preventing poor contact caused by foreign material.

Figure 8:
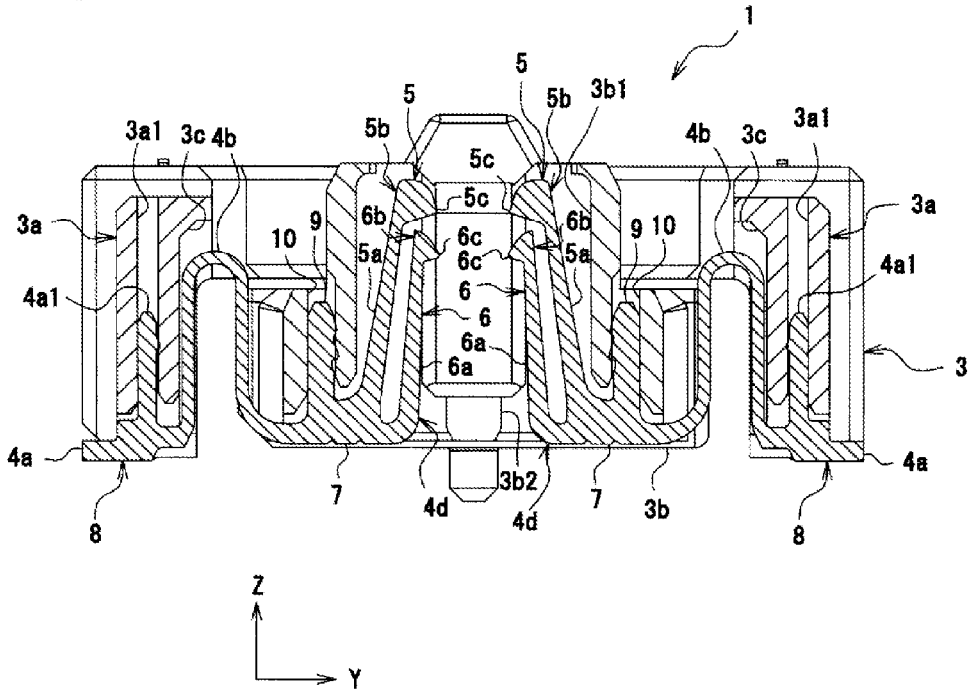
FIG. 8 is a sectional view of a socket according to a second embodiment.
Figure 9:
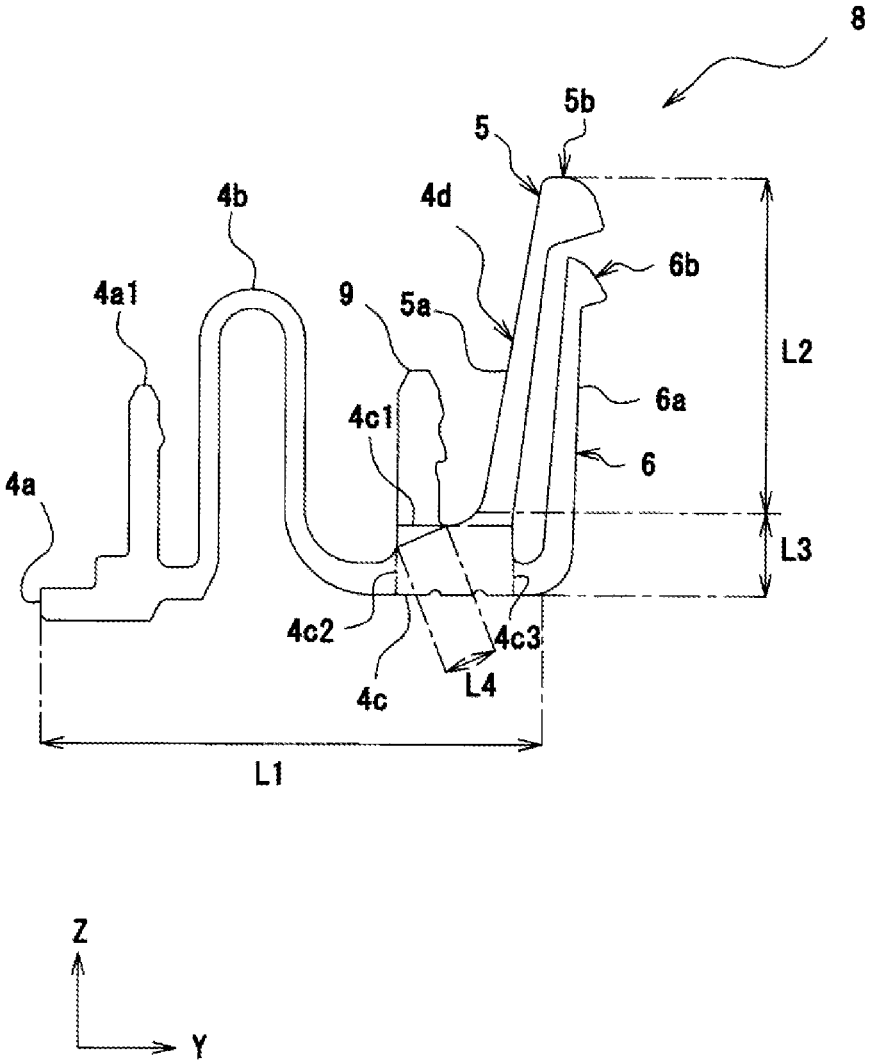
FIG. 9 is a side view of a socket terminal according to the second embodiment used in measuring impedance.
Figure 10:
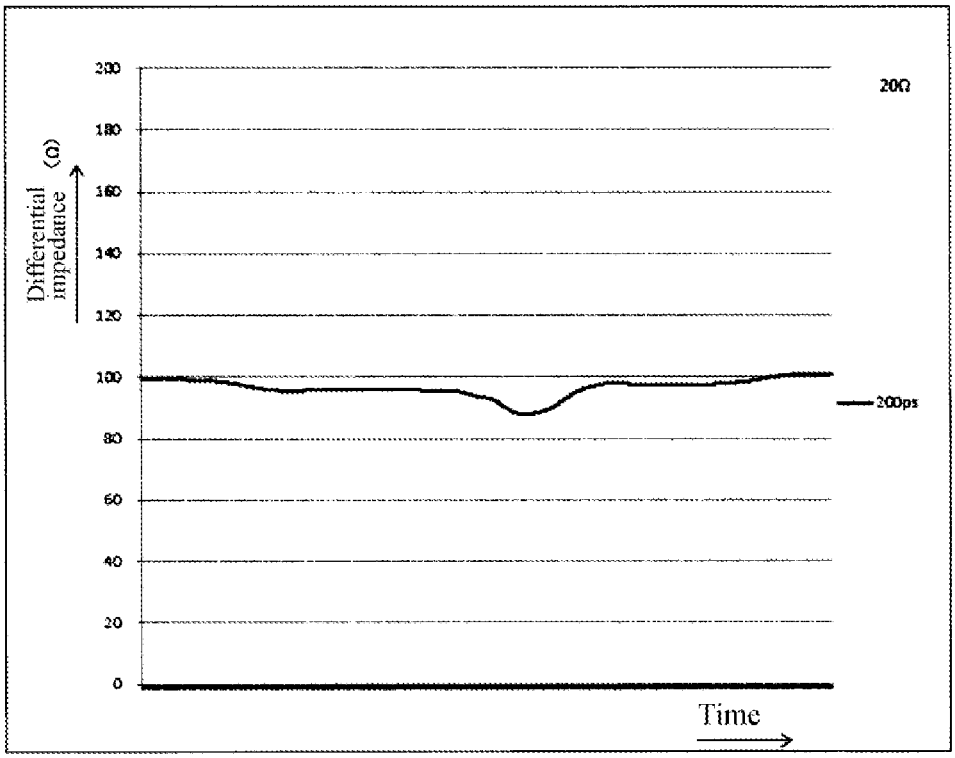
FIG. 10 is a graph of a waveform of impedance in the socket terminal shown in FIG. 9.

Second Embodiment (FIGS. 8 to 10)

In the first embodiment, each socket terminal 4 is one in which the plate surface of its corresponding base end portion 4*c* has a substantially square shape. However, as shown in FIG. 8, each socket terminal 8 may be one in which a plate surface of a base end portion 7 has a substantially rectangular shape that is long along a short-side direction of a socket 1. FIG. 9 shows a socket terminal 8, with a length L1 in a width direction being on the order of 5 mm, a height L2 of a terminal portion 4*d* being on the order of 5 mm, a height L3 of a base end portion 7 being approximately 0.6 mm, and a distance L4 between the base end portion 7 and the terminal portion 4*d* being approximately 0.87 mm. FIG. 10 is a graph of a waveform of impedance measured at the socket terminal 8. According to FIG. 10, the waveform has a linear form whose difference between impedances is less than that of the waveform of the impedance measured at the socket terminal 4. Therefore, by bringing the terminal portion 4*d* and a movable portion 4*b* even closer to each other than the terminal portion 4*d* and the movable portion 4*b* of the socket terminal 4, it is possible to increase the effect of canceling a reduction in the impedance of the terminal portion 4*d* by the movable portion 4*b*.

The lengths of elastic portions 5*a* and 6*a* are adjustable since the elastic portions 5*a* and 6*a* are elastically deformable. However, it is possible to reduce the height of the entire socket terminal 4 by reducing the height of the base end portion 7 without reducing the length of the elastic portions 5*a* and 6*a*. Therefore, even if the interval between a circuit board G1 and a circuit board G2 is small, it is possible to reduce the height of the socket terminal 8 without influencing elastic deformations of the elastic portions 5*a* and 6*a*.

In the socket terminal 8 according to the embodiment, the range of a side edge 4*c*3 of the base end portion 7 that is positioned at the side of a partition wall 3*b*2 is narrow. Therefore, the range in which a holding portion 4*c*4 for securing the socket terminal 8 to a movable housing 3*b* is limited. Consequently, as shown in FIG. 8, instead of such a holding portion 4*c*4, a holding portion 9 that is secured to the movable housing 3*b* may be provided. The holding portion 9 is provided adjacent to a front terminal 5, and extends upward from the base end portion 7. The movable housing 3*b* is provided with a securing holding hole 10 that is used to secure the holding portion 9 when it is press-fitted to and is caused to mesh with the movable housing 3*b*.

As in the socket terminal 4, in the socket terminal 8, the front terminal 5 extends from an upper edge 4*c*1 of the base end portion 7. However, in the socket terminal 8, the elastic portion 6*a* of the rear terminal 6 extends from the side edge 4*c*3 instead of from the upper edge 4*c*1 of the base end portion 7. In addition, the rear terminal 6 is formed with a substantially L shape in which, from the side of the base end portion 7 towards a tip, its direction is changed upward. By forming the rear terminal 6 with a substantially L shape, it is possible to effectively use the side edge 4*c*3 of the base end portion 7 that is narrower than that of the base end portion 4*c* of the socket terminal 4.

Figure 11:
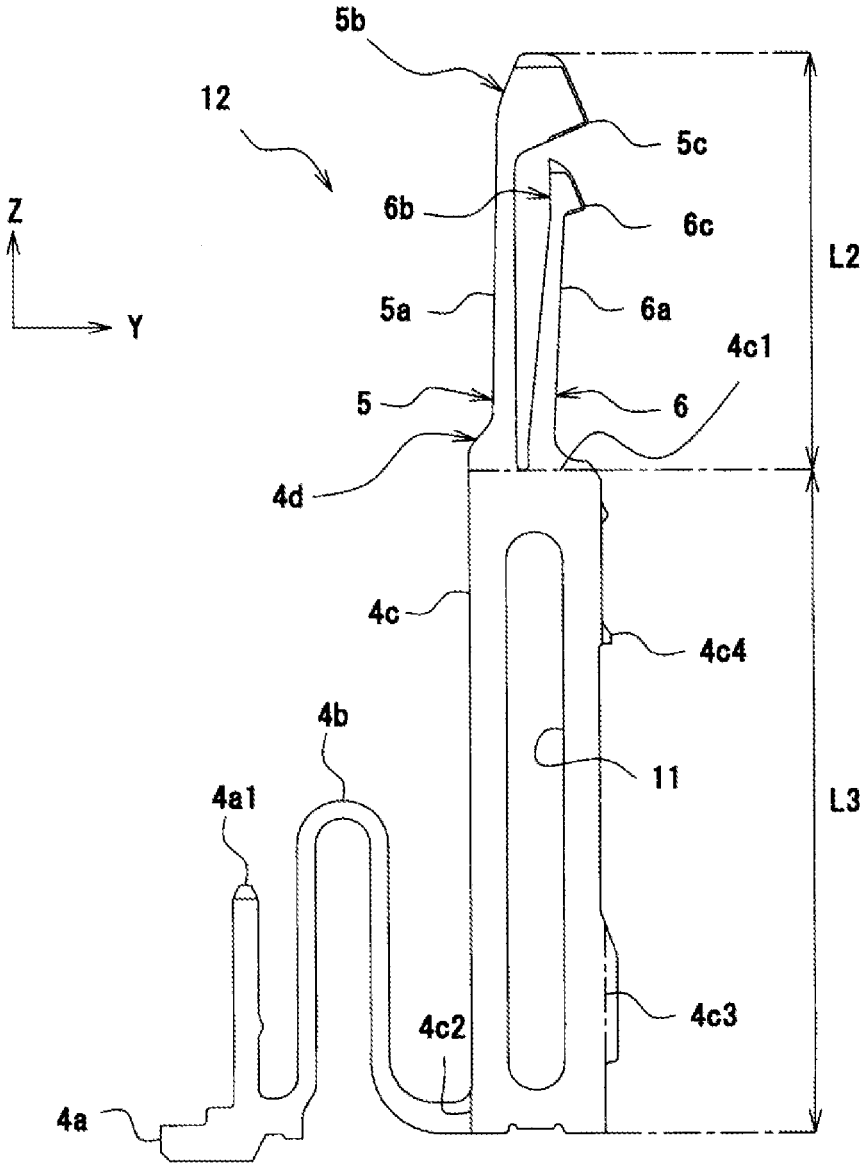
FIG. 11 is a side view of a socket terminal according to a third embodiment.
Figure 12:
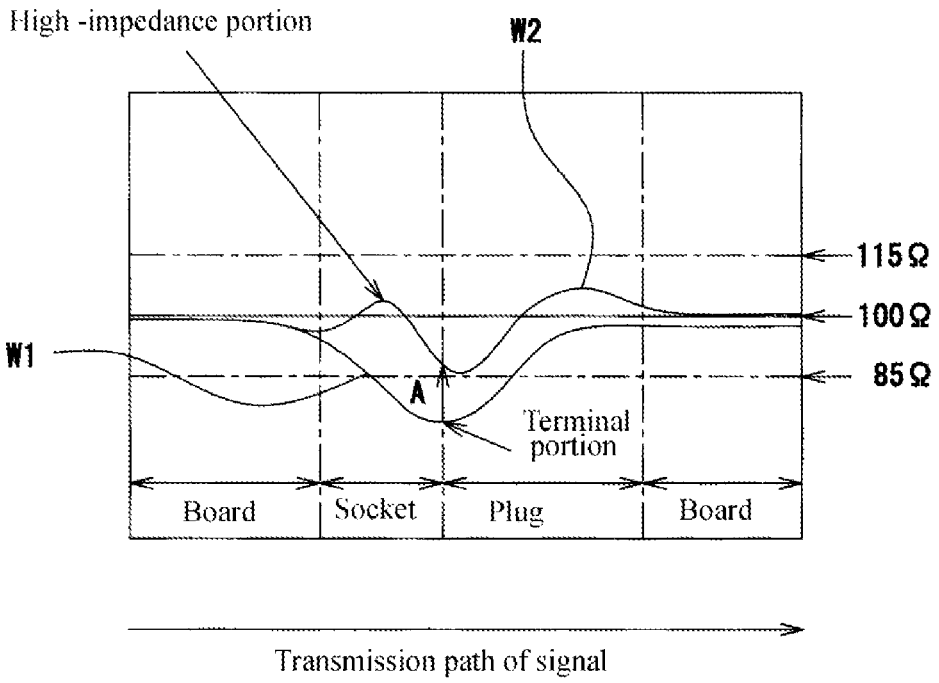
FIG. 12 is a graph of a waveform of impedance in describing the operation according to the present invention.

Third Embodiment (FIG. 11)

In the first and second embodiments, the socket terminals 4 and 8 including smooth, flat base end portions 4*c* and 7, respectively, are provided. In contrast, as shown in FIG. 11, it is possible to provide a socket terminal 12 having a through hole 11 that extends through a base end portion 4*c* along a plate thickness. By using such a socket terminal 12, the surface area of the base end portion 4*c* becomes small, so that a capacitor component is reduced. Therefore, it is possible to increase the impedances of portions beyond the base end portion 4*c*.

In the socket terminal 12, it is necessary to change the height of the base end portion 4*c* in accordance with a gap between a circuit board G2 and a circuit board G1 on which the socket terminal 12 is mounted. The larger the height of the base end portion 4*c*, the larger the capacitor component of a movable portion 4*b*. Since this causes a distance L4 between the movable portion 4*b* and a terminal portion 4*d* to be increased, it becomes difficult to cancel a reduction in the impedance of the terminal portion 4*d* by the movable portion 4*d*. By providing the through hole 11 in the base end portion 4*c*, it is possible to increase the impedance of the base end portion that is adjacent to the terminal portion having a low impedance and, thus, to increase the effect of canceling a reduction in the impedance of the base end portion 4*d*.

The larger the through hole 11, the smaller the surface area of the base end portion 4*c*. As a result, the impedance of the base end portion 4*c* is increased. Consequently, it is possible to change the size of the through hole 11 in accordance with the height of the base end portion 4*c*.

Modifications of the Embodiments

In each of the embodiments, application to a floating connector serving as an electric connector and including a socket housing 3 that includes a movable housing 3*b* and a stationary housing 3*a* is given as an example. However, application to an electric connector that does not have a floating structure, where the socket housing 3 does not include a movable housing, is also possible.

Although an example in which a movable portion 4*b* is provided as a high-impedance portion is given, the high-impedance portion need not be movable as long as it has a linear portion and a small surface area. Even, in this case, in order to increase the impedance, it is desirable that the high-impedance portion be exposed to air without being accommodated in a housing.

What is claimed is:

1. A connector terminal comprising:

a circuit-board connection portion that is connected to a circuit board;

a terminal portion that contacts a terminal surface of a mating connector; and a base end portion that supports an end of the terminal portion, wherein the terminal portion includes a front terminal and a rear terminal, the front terminal including an elastic portion and a front contact-point portion, the elastic portion of the front terminal extending in a cantilever manner from the base end portion in a fitting direction in which a connector is fitted to a mating connector, the front contact-point portion being supported at an end of the elastic portion of the front terminal and wiping off foreign material that is adhered to the terminal surface of the mating connector, the rear terminal including an elastic portion and a rear contact-point portion, the elastic portion of the rear terminal extending parallel to the elastic portion of the front terminal in a cantilever manner from an upper edge of the base end portion, the rear contact-point portion being supported at an end of the elastic portion of the rear terminal and contacting the terminal surface of the mating connector that has been wiped by the front contact-point portion, wherein a high-impedance portion is provided between the circuit-board connection portion and the base end portion, the high-impedance portion eliminating impedance mismatching at a terminal transmission path by canceling a reduction in an impedance at least the terminal portion as regards a transmission signal that flows from the circuit-board connection portion at a primary side to the terminal portion at a secondary side, wherein the high-impedance portion is a linear terminal section provided with a bent portion having a transmission length that cancels the reduction in the impedance at least the terminal portion, wherein, in the terminal transmission path, an impedance at a primary-side transmission path is made higher than an impedance at a secondary-side transmission path by the high-impedance portion serving as the terminal section, the primary-side transmission path being formed by the circuit-board connection portion and the high-impedance portion, the secondary-side transmission path being formed by the base end portion and the terminal portion, and wherein the high-impedance portion is adjacent to the base end portion and the terminal portion, and an end portion of the high-impedance portion at a side of the base end portion is directly connected to the base end portion and is close to the terminal portion, so that the reduction in the impedance at the terminal portion is canceled by increasing an impedance at the high-impedance portion before the impedance at the terminal portion is reduced.

2. The connector terminal according to claim 1, wherein the high-impedance portion is the terminal section that is exposed to outside without being covered by a connector housing.

3. The connector terminal according to claim 1, wherein the high-impedance portion is a movable portion that elastically supports the circuit-board connection portion and the base end portion so as to be displaceable relative to each other.

4. The connector terminal according to claim 1, wherein the base end portion has a through hole having a height along the fitting direction in which the connector is fitted to the mating connector, the through hole increasing an impedance at the terminal transmission path beyond the base end portion as a result of a reduction in a surface area of the base end portion.

5. The connector terminal according to claim 1, wherein the base end portion has a side edge along the fitting direction in which the connector is fitted to the mating connector, and wherein at least one of the front terminal and the rear terminal projects sideways from the side edge of the base end portion and, then, bends and extends in the fitting direction in which the connector is fitted to the mating connector.

6. The connector terminal according to claim 1, wherein a contact pressure of the rear terminal is higher than a contact pressure of the front terminal.

7. An electric connector comprising:

the connector terminal according to claim 1; and a housing that accommodates the connector terminal.

8. The electric connector according to claim 7, wherein the housing includes a stationary housing to which the circuit-board connection portion is secured and a movable housing to which the base end portion is secured, and wherein the high-impedance portion elastically supports the stationary housing and the movable housing so that the movable housing is displaceable relative to the stationary housing.

9. The electric connector according to claim 7, wherein the housing includes a space portion that exposes the high-impedance portion to air without contacting the high-impedance portion.

* * * * *